United States Patent [19]

Fabian

[11] 3,931,972

[45] Jan. 13, 1976

[54] TILTABLE SURFACE GAME TOY

[75] Inventor: James M. Fabian, St. Clair Shores, Mich.

[73] Assignees: Victor M. Fabian; Leo Garr, both of Detroit, Mich. ; part interest to each

[22] Filed: Apr. 2, 1975

[21] Appl. No.: 564,281

[52] U.S. Cl. ..... 273/110; 273/85 R

[51] Int. Cl.[2] ..... A63F 7/16

[58] Field of Search ..... 273/109, 110, 113, 115, 273/116, 118 A, 123 A, 126 A, 85 R

[56] References Cited

UNITED STATES PATENTS

| | | | |
|---|---|---|---|
| 471,706 | 3/1892 | McDougall | 273/109 |
| 700,589 | 5/1902 | Webb | 273/109 |
| 2,562,126 | 7/1951 | Rishel | 273/110 |
| 3,090,622 | 5/1963 | Sire | 273/126 A |
| 3,479,033 | 11/1969 | Crisafulli et al. | 273/110 |
| 3,751,038 | 8/1973 | O'Keefe | 273/110 |
| 3,787,055 | 1/1974 | Kraemer | 273/110 |

FOREIGN PATENTS OR APPLICATIONS

| | | | |
|---|---|---|---|
| 1,057,725 | 10/1953 | France | 273/110 |

*Primary Examiner*—Richard J. Apley
*Assistant Examiner*—Harry G. Strappello
*Attorney, Agent, or Firm*—Cullen, Settle, Sloman & Cantor

[57] ABSTRACT

A tiltable surface game toy includes an open top housing assembly and mounted therein a universally tiltable open top insert assembly. Upright guides within the housing assembly guide vertically adjustable lifters with handles which project laterally outward through slots in the end walls of the housing assembly. Said lifters supportably engage the undersurface of the insert assembly. Selective vertical manual movements of one or more lifters are adapted to variably adjust the insert assembly to any resultant angle relative to a horizontal plane throughout 360° selectively. Game board indicia is provided upon the insert assembly bottom wall to receive a series of variably spaced targets or obstacles. A ball initially disposed on the indicia is movable thereover relative to the insert assembly walls in various directions depending upon the resultant tilt of the insert assembly so as to strike or not strike said targets or obstacles.

10 Claims, 8 Drawing Figures

FIG. 4
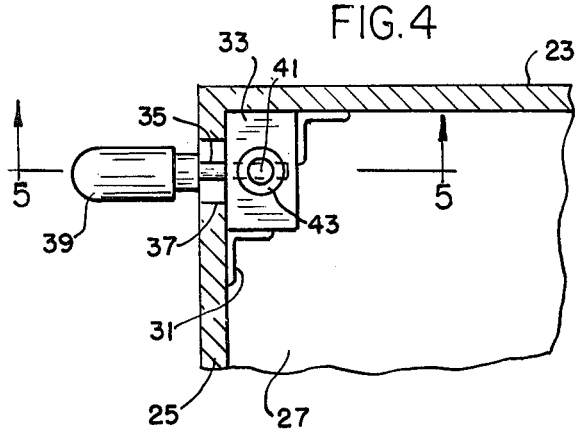
FIG. 5
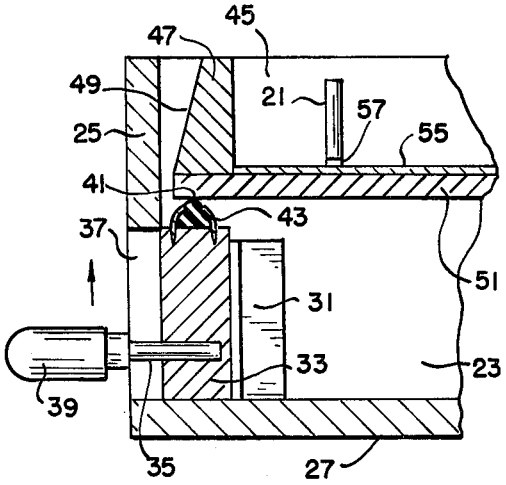
FIG. 6
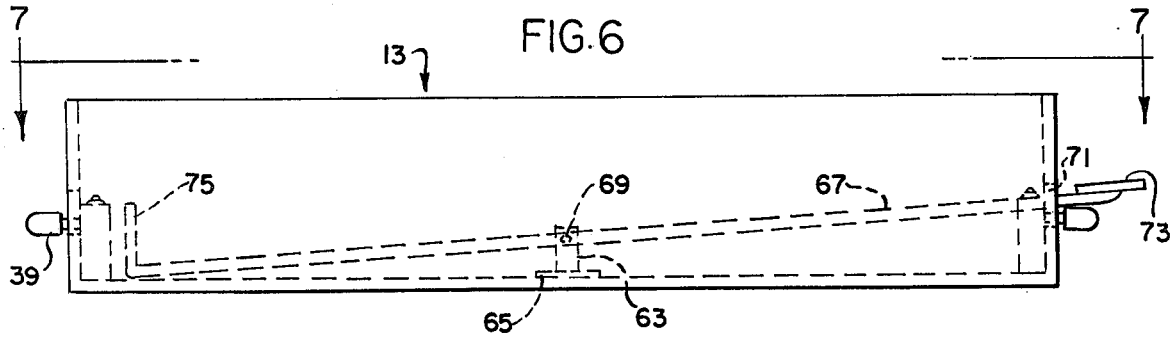
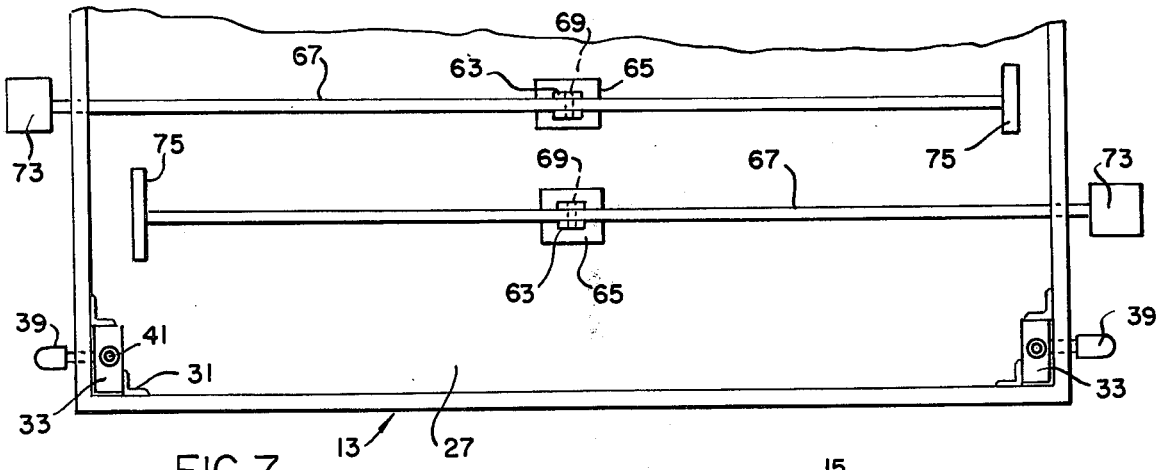
FIG. 7
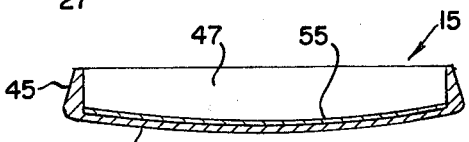
FIG. 8

TILTABLE SURFACE GAME TOY

BACKGROUND OF THE INVENTION

The art will show various patents directed to tiltable surface game toys such as illustrated in the following U.S. Pat. Nos.:

| | | |
|---|---|---|
| 3,479,033 | Crisafulli et al | 1969 |
| 2,522,782 | Glickman | 1950 |
| 3,539,188 | Salverda | 1970 |
| 3,554,553 | Hayashi | 1971 |
| 3,680,864 | Peterson | 1972 |
| 3,751,038 | O'Keefe | 1973 |
| 3,787,055 | Kraemer | 1974 |
| 3,815,917 | Brown | 1974. |

These old disclosures represent efforts to provide tiltable surface game toys which accomplish similar results but with very involved and composite structures functioning in a different manner. The average of said patents provides merely a tiltable game surface within a support housing where depending upon the tilt of the game surface, arrived at in various manners, causes a ball or other object to move with respect to the walls of the main housing for striking or reaching certain targets.

BRIEF DESCRIPTION OF THE INVENTION

It is an object of the present invention to provide an improved and simplified tiltable surface game toy with novel control mechanism for effecting tilting movements of the bottom wall of an insert assembly to provide resultant planer inclinations with respect to the horizontal, and throughout 360°.

This and other objects will be seen from the following specification and claims in conjunction with the appended drawings in which:

THE DRAWINGS

FIG. 4 is a fragmentary plan section taken in the direction of arrows 4—4 of FIG. 3.

FIG. 5 is a fragmentary section taken in the direction of arrows 5—5 of FIG. 4.

FIG. 6 is a fragmentary partially sectioned view of a modified housing assembly.

FIG. 7 is a fragmentary plan view thereof taken in the direction of arrows 7—7 of FIG. 6.

FIG. 8 is a section taken in the direction of arrows 8—8 of FIG. 5 illustrating a modification with the bottom wall of the insert assembly transversely arcuate.

It will be understood that the above drawings illustrate merely a preferred embodiment of the invention, and that other embodiments are contemplated within the scope of the claims hereafter set forth.

DETAILED DESCRIPTION OF THE INVENTION

Figure 1:
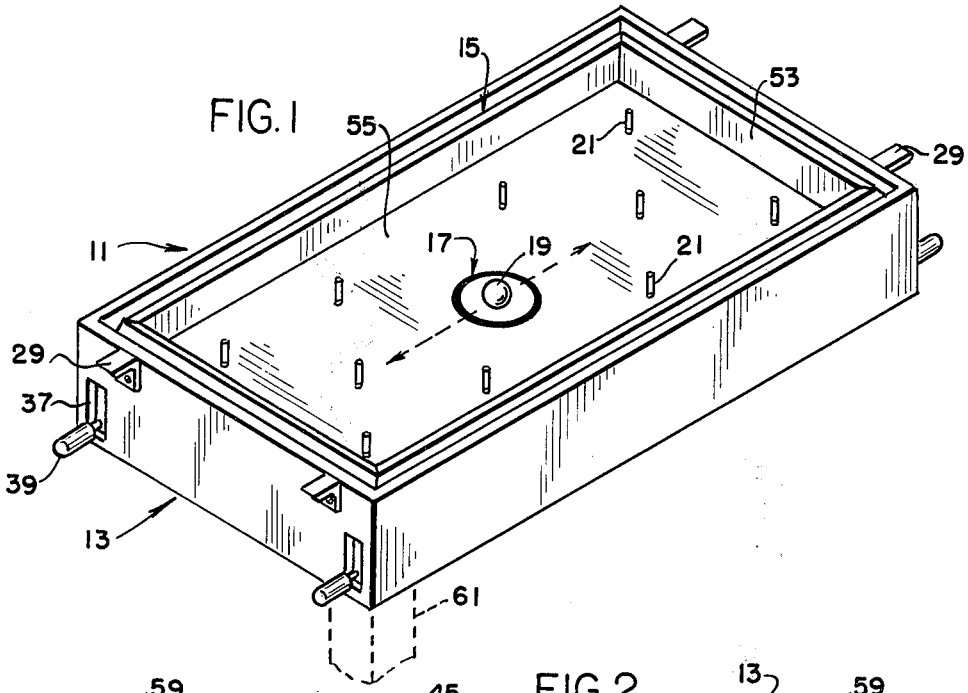
FIG. 1 is a front perspective view of a tiltable surface game toy in accordance with the present invention.

Referring to the drawing, the present tiltable surface game toy is generally indicated at 11, FIG. 1, as including an exterior open top housing assembly or box 13 and movably positioned therein the open top insert assembly 15 having upon its bottom wall suitable design indicia 17 for a predetermined game board. In the illustrative embodiment, a series of variably located spots 17' form a part of the indicia, and serve for locating the upright target pins 21.

The housing assembly 13 includes spaced side walls 23, spaced end walls 25 and bottom wall 27 as in FIGS. 1 through 5.

Outwardly projecting handles 29 are secured to and extend from the respective end walls of the housing assembly adjacent the corners thereof. These handles, in addition to the conventional use of transporting the housing assembly, serve as a reaction base to facilitate manual adjustments of the control handles 39, FIG. 1, hereafter described.

Within and adjacent the interior corners of the housing assembly are mounted a pair of upright parallel spaced 90° corner guides 31, FIG. 4, adapted to guidably receive the vertically adjustable lift blocks 33.

A longitudinally extending dowel 35 is secured to and projects outwardly of each lift block, through a corresponding vertical slot 37 in the housing assembly end walls and terminates in the control handle 39, FIGS. 1 through 5.

Ball bearing 41 is movably nested within a suitable holder 43 upon the upper surface of each of the lift blocks 33, adapted for supporting registry with the exterior undersurface corners of the insert assembly 15.

Figure 3:
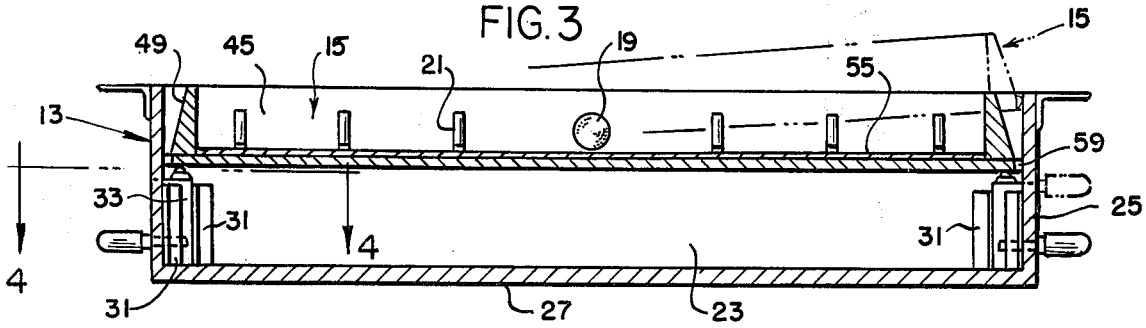
FIG. 3 is an elevational section taken in the direction of arrows 3—3 of FIG. 2.

Said insert assembly is in the nature of an open top box having upright spaced side walls 45, spaced end walls 47 which taper upwardly and inwardly as at 49, FIGS. 3 and 5, and bottom wall 51.

In the illustration shown in FIGS. 1 through 5, the bottom wall is normally flat and planer. However, it is contemplated that the bottom wall may be transversely arcuate as shown in FIG. 8 at 51.

The inner surfaces of the respective side and end walls of the insert assembly are upright as at 53, FIG. 1.

In the construction of the insert assembly, overlying the bottom wall thereof is a sheet metal strip 55 of a magnetic character to which is applied the design indicia 17 depending upon the type of game to be played. In the illustrative embodiment in FIG. 1, there is merely shown a central circle at 17 with a series of variably spaced spots 17', FIG. 2, overwhich are positioned target pins 21 which have magnets 57 at their lower ends for cooperative securing registry with the target spots 17'.

Figure 2:
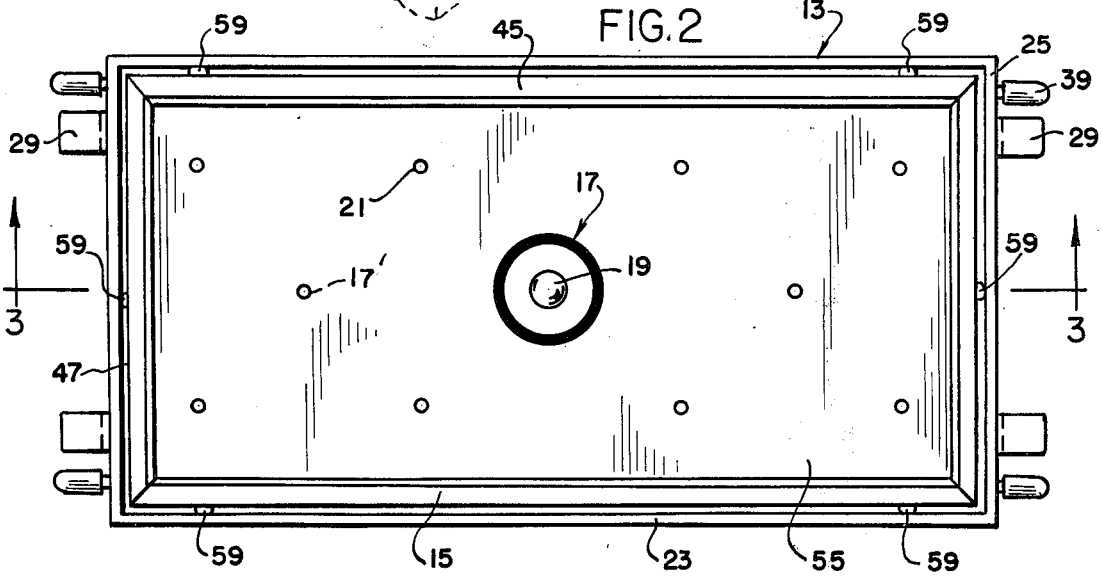
FIG. 2 is a plan view thereof on a slightly increased scale.

A series of spaced spacer buttons 59 project from the end and side walls of the insert assembly adjacent its bottom wall and are adapted for cooperative registry with the corresponding side and end walls of the housing assembly, as best shown in FIG. 2.

The present housing assembly may be mounted upon a suitable table for use or could be supported by a series of legs such as the leg 61, fragmentarily shown in FIG. 1.

A modified housing assembly is shown in FIGS. 6 and 7 wherein, a fulcrum 63 is anchored at 65 centrally upon the bottom wall of the housing assembly 13. A tilt control arm 67 intermediate its ends is pivotally mounted at 69 upon said fulcrum with its inner end terminating in the upright actuator bar 75.

The opposite end of said arm projects outwardly through the upright slot 71 in one end wall of the housing assembly and terminates in the handle 73. The auxiliary or additional tilt control arm 67, through its handle 73, is adapted to provide a means by which one player using the game toy, can elevate the opposite end of the insert assembly.

A second such tilt control arm 67 is shown in FIG. 7, projecting from the opposite end of the housing assembly. There may be a pair of such arms extending from both ends of the housing assembly, available to each opponent. These arms serve to prevent any one opposing player from dominating control of the ball at one end of the playing surface, which he controls, utilizing control handles 39.

OPERATION

In operation with a ball centrally disposed within the insert assembly within the indicia 17 for that particular game board, which ball may be rubber or metallic, the manual adjustment of any one or two or three or four of the respective handles 39 at opposite ends of the housing assembly will cause a resultant angular inclination of the playing area; namely, the bottom of the insert assembly in any direction throughout 360° with respect to the horizontal. Depending upon which handles are actuated, and the resultant inclination of the game board and indicia, ball 19 will roll in the resultant path. Assuming there are two players, one at each end of the housing assembly, the targets 21 adjacent one end will be of one color and the target elements 21 at the opposite end; namely, pins in this embodiment will be of a different color, merely for identification and corresponding to the player at the opposite end of the housing assembly.

Depending upon the careful manipulation of the control handles 39 by the respective players, each of the opposing parties is endeavoring to control the direction of movement of the ball 19 so as to knock down his opponent's pins. Unless struck by the rolling ball 19, the pins will remain snug upon the playing surface due to the magnets 57 at the lower end of the target pins 21. However, the striking of the ball with respect to the pin will dislodge the pin from its spot and will count against the defending player.

The outer upward and inward taper 49 of the respective walls of the insert assembly provides for clearance thereof with respect to the housing assembly when tilted such as to the position shown in FIG. 3. Accordingly, the insert assembly is supported upon the ball bearings 41 of the lift blocks 33 and is spaced with a minimum of friction from the corresponding interior walls of the housing assembly by the spacers 59, FIG. 2.

A variety of games can be manufactured, based upon the concept of controlling the tilt of the playing surface. The tilt of the playing surface may be controlled through the present lifters exerting pressure on points from under the playing surface.

The objective of controlling the tilt of the playing surface is to allow the force of gravity to alter the position of the ball or any other device capable of sliding or rolling with the forces generated from the tilting of the playing surface.

There are an indefinite number of possible game designs which could be incorporated into the present invention. Any number of possible obstacles or targets 21, mounted or not mounted, may be placed upon the playing surface to allow "game-like" competition between opponents playing the game. Apertures may be incorporated into the playing surface or other obstacles placed or mounted thereon. The present game operates on the principle of controlling the tilt of the playing surface to allow "gamelike" competition between two or more players, or may be used by one player to test his skills at a variety of different challenges afforded with the obstacles or devices present on the playing surface.

The objective of the game, in most cases, will be to knock over an opponent's pins or target with the ball rolling along the playing surface. Each opponent utilizes his control devices; namely, the lift blocks in altering the tilt of the surface to his advantage. The first player to knock over all of his opponent's pins or targets is the winner.

By placing goals at opposite ends of the playing surface, the game of hockey may be simulated. Here, each opponent will attempt to maneuver the ball or puck, utilizing his control over the tilt of the playing surface so as to direct the puck into his opponent's goal. Mechanical or electrical gadgetry may be incorporated into the present game toy so as to automatically register when a goal is scored and/or talley the number of goals on a scoreboard. No claim is made to such electronic gadgetry and no further description thereof is given.

Basketball may be simulated in the same fashion by modification of the indicia 17 for the game board as shown in FIG. 1.

War games may be played, utilizing devices which control the tilt of the playing surface; namely, applicant's lift blocks 33. While one opponent locates ships, ports or air-bases designated by pins or other identifiable playing pieces 21 on the playing surface, the opposing player manipulates the position of the metal ball on the playing surface in an effort to destroy (i.e., knock down) his opponent's military and naval resources. Magnetic devices may be variably located upon the undersurface of the game board which will have the effect of locking in place the metal ball of an opponent. Thus, the ball is lost to the enemy defenses. Additional balls may be utilized. The number of metal balls available to a player and his "search and destroy" efforts may be regulated by game rules.

Theoretically, the object could be to "chase and apprehend" opponent's differently colored magnetic balls.

There are an indefinite number of game designs which may be incorporated by modification of the indicia 17 upon the playing surface of the insert assembly. These would include simulated games from the group consisting of variations of cops and robbers, sea search, basketball, hockey, war games, pinball and bowling, but not excluding others within the imagination of the user.

The exact location of the targets 21 or obstacles and the form thereof will vary in accordance with the game, as will also whatever other indicia 17 is applied to the game surface to render the game more interesting. It is contemplated that for a single housing assembly, there may be provided a plurality of separately useable insert assemblies, with each insert assembly having a different game indicia therefor. It is contemplated to make the game more interesting that in some instances, the playing surface may be transversely arcuate as shown in FIG. 8 to render control more difficult, but more interesting and requiring more skill.

An additional auxiliary control is, furthermore, shown in FIGS. 6 and 7 whereby, one player playing alone can test his skill by controlling tilting of the opposite end of the game board. Both players may have this auxiliary control as in FIG. 7.

Having described my invention, reference should now be had to the following claims.

I claim:

1. In a tiltable surface game toy, an open top housing assembly mountable upon a support and including side, end and bottom walls;

a universally tiltable open top insert assembly loosely disposed within the said housing assembly and including side, end and bottom walls;

a pair of upright spaced corner guides secured adjacent each of the internal corners of said housing assembly to its respective side and end walls;

a vertically adjustable lift means guidably mounted between said corners and guides respectively;

outwardly extending arm means secured to each said lift means projecting outwardly through a coresponding upright slot in the end walls of the housing assembly and terminating in a handle;

said lift means supportably engaging the undersurface of said insert assembly at the corners thereof, whereby selective manual vertical adjustments of one or more of said lift means are adapted to angularly tilt the bottom wall of the insert assembly to any resultant angle with respect to a horizontal plane throughout 360°, selectively;

there being game board indicia upon said insert assembly bottom wall;

a series of variably spaced targets or obstacles mounted on said indicia;

and a ball initially disposed on said indicia, movably thereover in various directions relative to the insert assembly walls, depending upon the resultant tilt of said insert assembly bottom wall, so as to strike or not strike said targets.

2. In the game toy of claim 1, said lift means being a block, and a ball bearing mounted upon the top of each lift block.

3. In the game toy of claim 1, the outer surface of the side and end walls of the insert assembly being tapered upwardly and inwardly.

4. In the game toy of claim 1, laterally spaced spacers upon the side and end walls of the insert assembly adjacent its bottom wall, loosely engaging the corresponding walls of the housing assembly.

5. In the game toy of claim 1, a sheet metal strip overlying the bottom wall of said insert assembly; said game board indicia overlying said strip; said targets including a magnetic portion retainingly engaging said strip and indicia during tilting thereof, until struck by said ball.

6. In the game toy of claim 5, said indicia including a series of variably spaced locating spots for said targets, said targets being in the form of upright pins overlying said spots.

7. In the game board of claim 1, the bottom wall of said insert assembly being transversely arcuate in shape.

8. In the game toy of claim 1, a reaction handle projecting outwardly from the end walls of the housing assembly adjacent its corners to facilitate variable manual movements of the lift means.

9. In the game toy of claim 1, a fulcrum upon the bottom wall of the housing assembly centrally thereof; a tilt-control arm intermediate its ends pivoted upon said fulcrum; an upright insert assembly actuator bar at the inner end of said tilt control arm; the other end thereof extending through an upright slot in one end wall of the housing assembly and terminating in a handle; whereby, from one end of the housing assembly a player can remotely elevate the opposite end of said insert assembly, or prevent any opposing player from dominating control of the ball at one end of the playing surface under his hand control.

10. In the game toy of claim 9, there being an additional tilt control arm similarly fulcrumed upon said housing assembly and extending from its opposite end.

* * * * *